United States Patent [19]

Kreinin et al.

[11] 4,440,224

[45] Apr. 3, 1984

[54] METHOD OF UNDERGROUND FUEL GASIFICATION

[75] Inventors: Efim V. Kreinin; Kirill N. Zvyagimtsev; Nikolai A. Fedorov, all of Moscow, U.S.S.R.

[73] Assignee: Vesojuzny Nauchno-Issledovatelsky Institut Ispolzovania Gaza V Narodnom Khozyaistve I Podzemnogo Khranenia Nefti, Nefteproduktov I Szhizhennykh Gazov (Vniipromgaz), U.S.S.R.

[21] Appl. No.: 262,071

[22] PCT Filed: Oct. 20, 1978

[86] PCT No.: PCT/SU78/00001

§ 371 Date: Jun. 21, 1979

§ 102(e) Date: Jun. 11, 1979

[87] PCT Pub. No.: WO79/00224

PCT Pub. Date: May 3, 1979

[30] Foreign Application Priority Data

Oct. 21, 1977 [SU] U.S.S.R. ..... 2535860

[51] Int. Cl.[3] ..... E21B 43/243; E21B 43/30

[52] U.S. Cl. ..... 166/245; 48/DIG. 6; 166/261

[58] Field of Search ..... 166/245, 256, 260, 261, 166/50; 299/2; 48/DIG. 6

[56] References Cited

U.S. PATENT DOCUMENTS

| | | | |
|---|---|---|---|
| 2,880,803 | 4/1959 | Parker | 166/245 |
| 3,221,811 | 12/1965 | Prats | 166/245 |
| 3,361,201 | 1/1968 | Howard | 166/261 |
| 3,766,982 | 10/1973 | Justheim | 166/261 |
| 3,775,073 | 11/1973 | Rhoades | 166/256 X |
| 3,952,802 | 4/1976 | Terry | 166/261 X |
| 4,010,800 | 3/1977 | Terry | 166/258 |
| 4,010,801 | 3/1977 | Terry | 166/261 |
| 4,026,356 | 5/1977 | Shuck | 166/245 X |
| 4,026,357 | 5/1977 | Redford | 166/261 |
| 4,059,151 | 11/1977 | Terry | 166/258 |
| 4,069,867 | 1/1978 | Bissett | 166/256 |
| 4,069,868 | 1/1978 | Terry | 166/258 |
| 4,092,052 | 5/1978 | Terry | 299/2 |
| 4,099,567 | 7/1978 | Terry | 166/261 |
| 4,127,171 | 11/1978 | Allen | 166/261 X |

FOREIGN PATENT DOCUMENTS

| | | |
|---|---|---|
| 59026 | 2/1941 | U.S.S.R. . |
| 87035 | 11/1964 | U.S.S.R. . |

*Primary Examiner*—George A. Suchfield
*Attorney, Agent, or Firm*—Steinberg and Raskin

[57] ABSTRACT

For mining combustible minerals a plurality of boreholes are drilled in a gasifiable seam, e.g., in a coal bed, said boreholes 1 through 4 being intercommunicated by a number of gasification ducts. Then the combustible mineral is initiated to fire, and an oxygen-containing blast gas is blown through some of said boreholes into the gasification ducts, with the result that the generator gas is formed. Simultaneously a carbon- and/or hydrogen-containing blast gas is blown through other boreholes situated along the flow of the generator gas to enrich the latter with combustible ingredients. As a result some chemical reactions proceed under the effect of heat produced by the generator gas, whereby additional amounts of combustible elements are formed which add to the calorific value of the generator gas being withdrawn. The method is instrumental also in controlling the composition of the generator gas withdrawn by varying the ratio of the components of the blast gas enriching the generator gas.

7 Claims, 2 Drawing Figures

METHOD OF UNDERGROUND FUEL GASIFICATION

FIELD OF THE INVENTION

The present invention relates to mining combustible minerals, and has particular reference to a method of underground fuel gasification.

DESCRIPTION OF THE PRIOR ART

Two methods of underground fuel processing are known in the present state of the art, of which one is based upon filtering the blast gas blown through the boreholes drilled in the seam of the mineral, say, coal bed, while the other method makes use of the gasification process occurring in special ducts prepared in the seam of the mineral to be processed, e.g., coal bed.

More explicitly the filtration method incorporates drilling a number of boreholes in a coal bed, setting fire to the latter, and alternative blowing of an oxygen-containing blast gas, such as air, steam, carbon dioxide, etc., whereupon the reaction products of said blast gas are withdrawn from the same borehole that has served as a blow-down one, or from adjacent boreholes. However, application of the above method involves inescapably substantial irrecoverable losses of the blast gas and heat evolved, occurring in the coal bed and its enclosing rock. Furthermore, said method may be realized only at restricted flowrates of the blast gas. Thus, both of the aforesaid features of the method described above affect adversely the efficiency thereof.

The other of the afore-discussed methods proved to be more promising, viz., the method of duct gasification. To carry said method into effect a number of boreholes are drilled in the coal bed and interconnected by resorting to one of the conventionally practised methods of cross-cutting (fire-type filtration breakthrough of bore-holes, hydraulic coal bed fracturing, drilling boreholes on bed strike). Next the coal bed fired up, and an oxygen-containing blast gas is blown into one of the boreholes, which reacts with carbon or the walls of the ducts to yield generator gas. In addition, steam is blown into the borehole along with the oxygen-containing blast gas to enrich the producer gas with combustible elements. The generator gas is withdrawn through gas-discharge boreholes located at the other end of the duct.

The abovesaid method suffers from the disadvantages that it fails to yield generator gas having a calorific value in excess of 1000 kcal/m$^3$ resorting to air-blast technique, and that a great deal of irrecoverable losses of physical heat of the generator gas is involved.

Both of the aforesaid disadvantages render said method impracticable for processing coal beds less than 2.0 m thick.

There has been developed in the recent years one novel method of coal gasification in ducts, wherein the process of drilling boreholes, their interconnecting and setting fire to the coal bed remains the same as in the preceding method. A substantial distinguishing feature of the novel method resides in that the feed of an oxygen-containing blast gas is periodically ceased, and a carbon- and/or hydrogen-containing blast gas is fed in the thus-occurred time intervals to obtain a producer gas rich in gaseous and liquid combustible substances (cf., e.g., U.S. Pat. No. 4,059,151 filed on Mar. 4, 1976 and granted on Nov. 11, 1977).

A disadvantage inherent in said method resides in an intermittent character of the process being carried out and its poor controllability and in the fact that the final products widely differ in the composition due to alternating feed of an oxygen- and carbon- and/or hydrogen-containing blast gas, which requires separate withdrawal and application of each of the products yielded.

DISCLOSURE OF THE INVENTION

It is a primary object of the present invention to carry out such an interaction of the producer gas and a gas enriching the latter with combustible elements as to provide most complete utilization of the heat withdrawn by the generator gas, as well as better conditions for control of the gasification process.

Said object is accomplished due to the fact that in an underground fuel gasification, incorporating the drilling a plurality of boreholes intercommunicating through gasification ducts, setting fire to the fuel, blowing an oxygen-containing blast gas to the gasification ducts through said boreholes so as to yield generator gas, and blowing a carbon- and/or hydrogen-containing blast gas so as to enrich said producer gas with combustible elements, according to the invention said oxygen-containing blast gas is blown concurrently with said carbon- and/or hydrogen-containing blast gas for enrichment, the latter gas being fed into the borehole situated in the area of the generator gas withdrawal outside the zone of blowing the oxygen-containing blast gas.

An advantageous feature of the herein-proposed method resides in the fact that a more complete utilization of physical heat of the generator gas is attained due to blowing a blast gas into the zone of withdrawing the hot generator gas to enrich the latter with combustible elements. Thus, physical heat of hot (about 1000° C.) producer gas is usefully consumed for such reactions as reduction of steam and carbon dioxide, and decomposition of hydrocarbons, said reactions proceeding mainly as endothermic ones only. The resultant elements ($H_2$, CO and $CH_4$) enrich the producer gas due to their being combustible ones.

Thus, physical heat of the generator gas which was wasted irrecoverably in the prior-art processes now passes into chemical heat of the obtained mixture of the generator gas with said combustible elements. Owing to this fact one manages to obtain an underground-gasification gas having a calorific value (e.g., with an air blast) substantially exceeds 1000 kcal/m$^3$. Moreover, an opportunity is afforded to adjust the ratio of the gas components. Thus, for instance, blowing a carbon- or hydrogen-containing blast gas in various combinations and amounts into the zone of withdrawal of hot producer gas, one can obtain underground-gasification gases for different synthesis processes, i.e., those featuring various $H_2$-to-CO ratios.

Used as an enrichment blast gas for the producer gas may be steam, carbon dioxide, some gaseous hydrocarbons, or else hydrogen, as the latter not only retards undesirable conversion reactions of carbon monoxide and methane but also promotes the coursing of the coal hydrogenation reactions.

It is expedient that all the aforesaid components, viz., steam, carbon dioxide, a gaseous hydrocarbon, and hydrogen be fed into the zone of the producer gas withdrawal and that hydrogen be fed last as along the flow of producer gas.

DESCRIPTION OF THE PREFERRED EMBODIMENTS

Figure 1:
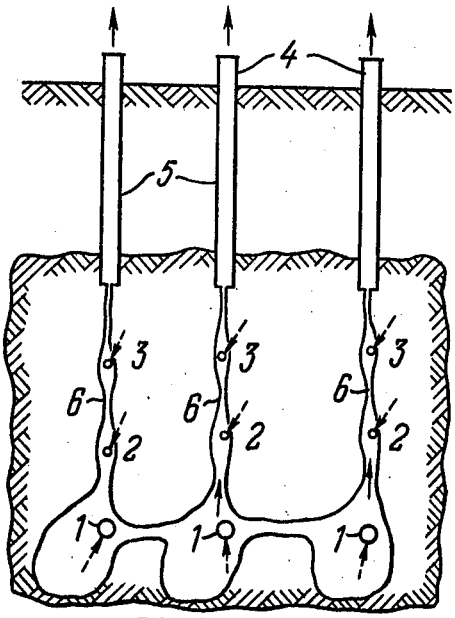
FIG. 1 illustrates a layout of boreholes and ducts for carrying out the underground gasification process according to the proposed method, is inclined coal beds, wherein solid arrows indicate the direction of withdrawal of the producer gas, while dotted arrows show the direction of blast gas feed.

In order to carry the herein-proposed method into effect a plurality of vertical boreholes 1, 2, 3 (FIG. 1) are drilled in inclined coal seams, said boreholes being arranged in rows on the rise of the coal seam. The boreholes 1 are adapted for feeding an oxygen-containing blast gas, and the boreholes 2 are adapted for feeding an enriching blast gas, i.e., steam, carbon dioxide and hydrocarbons, all of these components being fed in various combinations and amounts so as to suit the desired composition of the end product. Therefore the principle of selecting the ratio of the components being blown into the boreholes will hereinafter become evident to those skilled in the art upon consideration of chemical mechanism of the processes involved. The boreholes 3 arranged last as along the flow of the producer gas are for hydrogen to feed thereinto.

Boreholes 4 having a cased portion 5 and an uncased portion 6 that has been sunk in coal bed, serve for withdrawing the underground-gasification gas thus yielded. Said boreholes having been drilled, they are interconnected by any conventionally known methods of cross-cutting.

The abovesaid operations over the coal seam is fired up in one of the boreholes, whereupon an oxygen- or steam-oxygen blast gas is blown into the boreholes 1. the result is that the following basic reactions proceed within the zone of feeding said blast gas:

$$C+O_2=CO_2+q1, \quad (1)$$

$$2C+O_2=2CO+q2, \quad (2)$$

$$2CO+O_2=2CO_2+q3, \quad (3)$$

$$C+CO_2=2CO-q4, \quad (4)$$

$$C+H_2O=CO+H_2-q5, \quad (5)$$

$$C+2H_2O=CO_2+H_2-q6, \quad (6)$$

$$CO+H_2O=CO_2+H_2+q7, \quad (7)$$

$$CO+3H_2=CH_4+H_2O+q8, \quad (8)$$

$$C+2H_2=CH_4+q9, \quad (9)$$

where

+q is the heat evolved in the reaction process,

−q is the heat absorbed in the reaction process.

The nascent producer gas flowing from the borehole 1 in the direction shown with the arrows, contains $CO_2$, CO, $H_2O$, $H_2$, $CH_4$. The content of useful combustible elements ($H_2$, CO and $CH_4$) in said gas is very low, and the producer gas has a temperature of about 1000° C.

According to the herein-proposed method a carbon- and/or hydrogen-containing blast gas is fed through the boreholes 2 concurrently with the aforesaid blast gas.

Now let us consider the case where a superheated steam is fed into the boreholes 2. The basic reactions occurring in this case are 5 and 6, which proceed within the zone of withdrawal of the producer gas. The reactions yield some useful combustible products, viz., $H_2$ and CO, thus adding much to the calorific value of the resultant gaseous mixture.

If carbon dioxide is fed into the boreholes 2, some extra quantity of CO is formed, according to the reaction 4, which also adds to the calorific value of the producer gas obtained.

If hydrocarbons are fed into the boreholes 2 they are decomposed and enrich the gaseous mixture with methane and hydrogen.

Hydrogen is then fed through the boreholes 3 into the zone of flowing of an enriched mixture of the producer gas cooled down to 400° or 500° C. as a result of the proceeding reactions 4, 5, and 6. In this case the reaction 9 takes place (i.e., coal hydrogenation reaction) to enrich the producer gas with such a highly calorific product as methane. The reaction 9 proceeds at a higher rate under increased pressure, that is why the underground coal gasification process carried out at a high pressure conduces to a greater methane content in the thus-produced gas.

It stands to reason that all the above-specified components may be fed at a time. The composition of the resultant producer gas, or more exactly, an enriched producer gas can be controlled by varying the amount and composition of the blast gases fed for enrichment.

Figure 2:
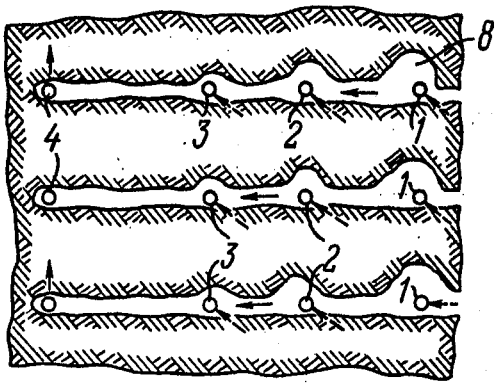
FIG. 2 illustrates the same layout as in FIG. 1 but for level coal seams, wherein solid arrows indicate the direction of withdrawal of the producer gas, and dotted arrows show the direction of blast gas feed.

FIG. 2 illustrates the mutual position of the vertical boreholes 1 through 4 for gasifying flat-dipping coal beds.

In this case the borehole 1 is adapted for an oxygen-containing blast gas to blow into, while the boreholes 2 are for feeding an enriching blast gas, and the boreholes 3, for feed of hydrogen. The resultant gas is withdrawn through the boreholes 4.

The gasification process is carried similarly to that with reference to FIG. 1, the character and chemical mechanism of the process being likewise similar to those described above.

The present invention can find most utility when applied for gasification of coal seams.

What is claimed is:

1. A process of underground fuel gasification, comprising the steps of providing an underground gasification duct and a plurality of boreholes communicating with said gasification duct in material to be gasified, igniting a portion of said material to be gasified in communication with said gasification duct so that gases resulting from the ignition pass into said gasification duct, introducing a first oxygen-containing gas through a first of said boreholes to form generator gas and create a zone of oxygen-containing gas introduction within said gasification duct, withdrawing said generator gas along said gasification duct away from said oxygen-containing gas introduction zone, to create a zone of generator gas withdrawal within said gasification duct, and introducing a second gas comprising at least one of a carbon-containing gas and a hydrogen-containing gas through a second of said boreholes in said zone of generator gas withdrawal, away from said oxygen-containing gas introduction zone, to enrich said generator gas, said second gas being introduced simultaneously with said first gas, whereby physical heat of said generator gas is substantially completely utilized and the ratio of gasified components within the generator gas is effectively controlled.

2. The process of claim 1 comprising the additional steps of providing a third of said boreholes in said gasification duct in said zone of generator gas withdrawal, downstream of said second borehole in the direction of generator gas flow, and introducing hydrogen gas through said third borehole into said zone of generator gas withdrawal, to enrich said generator gas, said hydrogen gas being introduced simultaneously with said first and second gases, whereby the gasification reaction, $$C+2H_2 \rightarrow CH_4+\text{heat},$$

between the flowing generator gas and the hydrogen gas introduced, is promoted.

3. The process of claim 2 wherein said second gas comprises a mixture of carbon dioxide, steam and hydrocarbons, whereby the following gasification reactions, $$C+CO_2 \rightarrow 2CO+\text{heat},$$

$$C+H_2O \rightarrow CO+H_2-\text{heat},$$

$$C+2H_2O \rightarrow CO_2+H_2-\text{heat, and}$$

the decomposition of the hydrocarbons to methane and hydrogen, between the following generator gas and the second gas introduced, are initially promoted prior to the introduction of the hydrogen gas through the third borehole, and the accompanying promotion of the gasification reaction $$C+2H_2 \rightarrow CH_4+\text{heat},$$

whereby the generator gas produced has an enriched methane content.

4. The process, of claim 3 wherein the generator gas formed in said oxygen-containing gas zone has a temperature of about 1,000° C., and said flowing generator gas in said generator gas withdrawal zone has a temperature of about 400°–500° C., whereby an enriched generator gas having a calorific value substantially exceeding 1,000 kcal/$m^3$ is produced.

5. The process of claim 1 wherein said second gas comprises stream, whereby the gasification reactions, $$C+H_2O \rightarrow CO+H_2-\text{heat, and}$$

$$C+2H_2O \rightarrow CO_2+H_2-\text{heat}$$

between the flowing generator gas and the second gas introduced, are promoted.

6. the process of claim 1 wherein said second gas comprises carbon dioxide, whereby the gasification reaction, $$C+CO_2 \rightarrow 2CO-\text{heat},$$

between the flowing generator gas and the second gas introduced, is promoted.

7. The process of claim 1 wherein said second gas comprises hydrocarbons, whereby said hydrocarbons are decomposed, enriching said flowing generator gas with methane and hydrogen.

* * * * *